US005309876A

United States Patent [19]

Schiattino

[11] Patent Number: 5,309,876

[45] Date of Patent: May 10, 1994

[54] AUTOMATIC VARIATOR OF VALVE OVERLAP AND VALVE SECTION

[76] Inventor: Miljenko Schiattino, Rivadavia 986, Piso 9, of. 33, (1002), Buenos Aires, Argentina

[21] Appl. No.: 6,944

[22] Filed: Jan. 21, 1993

[30] Foreign Application Priority Data

Jul. 20, 1992 [AR] Argentina ..... 322785
Jul. 31, 1992 [AR] Argentina ..... 322862

[51] Int. Cl.[5] ..... F01L 7/18
[52] U.S. Cl. ..... 123/190.2
[58] Field of Search ..... 123/190.1, 190.4, 190.6, 123/190.8, 190.15, 190.2, 90.16, 90.17, 90.18, 90.11

[56] References Cited

U.S. PATENT DOCUMENTS

| | | | |
|---|---|---|---|
| 1,863,875 | 6/1932 | Rabezzana | 123/90.18 |
| 2,839,036 | 6/1958 | Strang | 123/90.17 |
| 3,993,036 | 11/1976 | Tischler | 123/190.2 |
| 4,163,438 | 8/1979 | Guenther et al. | 123/190.2 |
| 4,463,712 | 8/1984 | Stojek et al. | 123/90.17 |
| 4,561,390 | 12/1985 | Nakamura et al. | 123/90.15 |
| 4,738,223 | 4/1988 | Hitomi et al. | 123/190.2 |
| 4,864,984 | 9/1989 | Blish | 123/190.5 |
| 4,976,227 | 12/1990 | Draper | 123/190.2 |
| 4,976.229 | 12/1990 | Charles | 123/90.17 |
| 4,986,801 | 1/1991 | Ohlendorg | 123/90.17 |
| 4,995,354 | 2/1991 | Morikawa | 123/190.2 |
| 5,080,055 | 1/1992 | Komatsu et al. | 123/90.17 |
| 5,105,784 | 4/1992 | Davis et al. | 123/190.2 |
| 5,174,253 | 12/1992 | Yamazaki | 123/90.17 |

FOREIGN PATENT DOCUMENTS

| | | | |
|---|---|---|---|
| 0237825 | 10/1986 | Japan | 123/190.1 |
| 2067264 | 7/1981 | United Kingdom . | |

OTHER PUBLICATIONS

Patent abstract of JP60125712, Inventor: Y. Tsukamoto, Published Jul. 5, 1985.

Patent abstract of JP3172521, Inventor: K. Tomita, Published Jul. 25, 1991.

*Primary Examiner*—E. Rollins Cross
*Assistant Examiner*—Erick Solis
*Attorney, Agent, or Firm*—Michael D. Bednarek

[57] ABSTRACT

An automatic variator for use in an internal combustion engine and other engines which use valve-type distribution systems, to operate a twin set of double-effect distribution sequential valve shafts for the purpose of regulating the valve overlap and the valve opening section while the engine is running. A motor reducer advances a spindle against the valve shaft with a grooved screw at one end of same, causing the shaft to turn and move, thereby varying the valve overlap and the valve section.

9 Claims, 5 Drawing Sheets

AUTOMATIC VARIATOR OF VALVE OVERLAP AND VALVE SECTION

FIELD THE INVENTION

The present invention relates to a device for use in internal combustion engines (i.e., cars, trucks, etc.) or any machine which uses double effect distribution sequential valve shaft as disclosed in co-pending application entitled DOUBLE EFFECT DISTRIBUTION SEQUENTIAL VALVE SHAFT, filed concurrently herewith, and incorporated herein by reference.

More particularly, the present invention deals with an automatic valve overlap and valve section variator, for use in internal combustion engines.

BACKGROUND OF THE INVENTION

The function of valves in internal combustion engines is related to the precise timing of the opening of the intake valve in relation to the opening of the exhaust valve at given points in the location of the piston, be it at the bottom or at the top of the cylinder. To permit the outflow of gases the exhaust valve begins to open at the end of the third stroke and remains open during the entire fourth stroke, at which point the intake valve begins to open before the first stroke. The instant during which both valves are open is designated "overlap" or "timing " in this description.

In the systems of the prior art, based on twin or dual overhead camshafts, in order to vary the overlap of an intake valve in respect to an exhaust valve, it is necessary to change, the angular placement (in vertical plane) of one of the camshafts with respect to the other. Once the change is accomplished the new valve overlap remains fixed.

There are known devices for changing the "overlap" or "timing " through rotation of camshafts while the engine is in operation. However, such devices are very sophisticated and are currently applied only in high-performance engines.

On the other hand, the double effect distribution sequential valve shaft system ("SVS") admits the same rotation through a variator mechanism which is embodied in the present invention.

In addition, this invention modifies the opening section, as more fully described below, to enlarge or reduce the space through which the gases will flow in the distribution system. In the prior art, the enlargement of valve area occurs only by depressing the valve deeper, which has proven to cause serious difficulties in the behavior of cams and springs.

SUMMARY OF THE INVENTION

The device of the present invention, unlike the prior art, allows the valve overlap and the opening section to be varied in a double effect distribution sequential valve shaft.

The present invention includes an automatic valve overlap or timing and valve section variator for use in internal combustion engines and machines which use valve-type distribution systems with cams or distribution valve shafts. The invention includes an automatic mechanism controlled by a microprocessor which is activated by a signal received from a tachometer, or gas analyzer, or both. The automatic mechanism activates a motor reducer with a step motor or a servo motor which turns a number of predetermined turns or steps. The motor reducer, by means of a hollow and internally threaded crown of the reducer, causes an end of a spindle to advance against bearings which push the SVS shaft against a dragging pulley by means of a multiple entrance grooved screw etched in at one end of the SVS shaft and an axle box inside the pulley in such a way that a differential and controlled turn is produced in the SVS shaft with respect to a dragging pulley. As a result the position of the SVS is changed angularly with respect to the other shaft. The valve overlap is thereby varied while the engine is turning.

The rotation which changes the angular position of the SVS shaft is concurrent with a longitudinal displacement of the shaft, both resulting from the action of the spindle against the end of the shaft. Such displacement will change the relative positions of the perforations or openings in the shaft and in the jacket in which the shaft is inserted, whereby their common area will be less than if they coincided entirely. The variation in valve area may occur in either sense, i.e. the common valve area may be increased or decreased. The step motor or servo motor can be actuated in forward or reverse with the effect of changing simultaneously the overlap and the valve section conditions of the distribution system. Such effect is obtained by the coordinated variation of both SVS shafts, one for intake and one for exhaust.

BRIEF DESCRIPTION OF THE DRAWINGS

The illustrations referred to below describe a single SVS and its variator mechanism, the reason being that the invention is best understood in these terms. However, the invention embodies a variator mechanism which only operates in a DOUBLE SVS, each shaft being provided with its own variator.

DETAILED DESCRIPTION

Figure 1A:
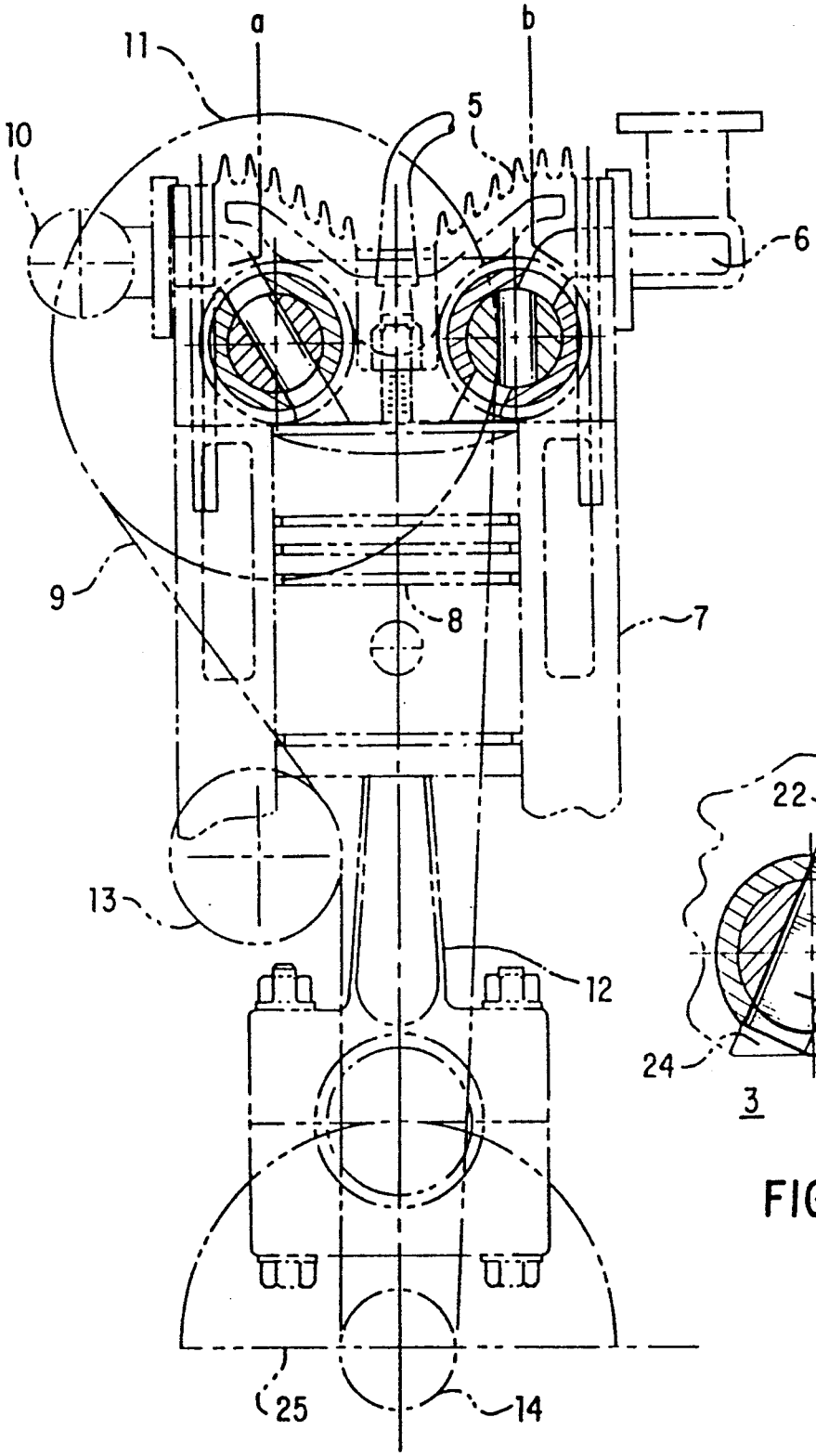
FIG. 1A illustrates the distribution system with which the present invention is used.
Figure 1B:
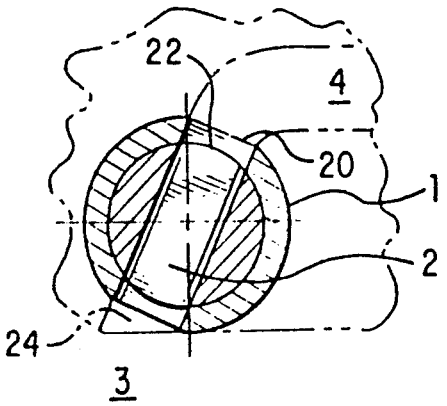
FIG. 1B illustrates a detailed view of a portion of the distribution system in FIG. 1A.

The present invention is described below by illustrating its function as it relates to a system in an engine with a double effect distribution sequential valve shaft system ("SVS"), as shown in FIGS. 1A and 1B, located in the cylinder head of the engine and driven by toothed pulleys and belts, gears, or chains with one shaft for intake and another for exhaust.

The SVS shafts include two longitudinal shafts (a) and (b) on the cylinder head 5 aligned with the engine axis, comprising a jacket 1 and a shaft formed with holes, i.e., a holed shaft. The engine includes motor block 7, piston 8, cylinder head 5, connecting rod 12, a distribution toothed belt 9, distribution and reduction toothed pulley 11, tension pulley 13, and motion distribution toothed pulley 14.

Since both shafts (a) and (b) (intake and exhaust) are practically identical, only one of them will be described. A housing for two jackets is provided in the cylinder head cover 5, with outer water chambers. The jacket 1, with perforations or openings 20 from side to side in the vertical plane of the jacket, is inserted into the housing under pressure and with a sealer. Each opening 20 coincides with a combustion chamber of each cylinder of the engine.

A double effect distribution sequential valve shaft 2 is mounted inside the jacket 1 with a very accurate tolerance. The shaft also has perforations or openings 22 extending from side to side in the vertical plane. Each opening 22 is separated from the other by the same distance between cylinders and is placed at a predetermined angle in the vertical plane, depending on the sequence of intake or exhaust on the type of engine.

Because the openings 22 of the shaft are side to side in the vertical plane, at every complete turn, one of the openings 22 communicates twice every turn through an opening 20 in the jacket 1 with a hole 24 in the head of one combustion chamber of a given cylinder 3, for which reason it is named "double effect." Thus, one complete turn of the crankshaft need only result in ¼ of a turn of the double effect distribution SEQUENTIAL valve shaft 2. The rotation of the valve shaft is transmitted from a pulley 14 on the crankshaft 25 by means of pulleys and toothed belts 11 and 9, with a corresponding difference of diameters to reduce the number of turns to 4:1. The exhaust or intake exit is shown at 4 in FIG. 1B.

The present invention is described below according to details of FIGS. 2A, 2B, 3, 4 and 5. The present invention is an automatic mechanism commanded by a servo-motor or a step motor whose turns are controlled by an electronic circuit. The electronic circuit receives instructions from a tachometer, gas analyzer, or both, which indicates the variations of valve overlap for a certain rate of revolutions per minute.

Figure 2B:
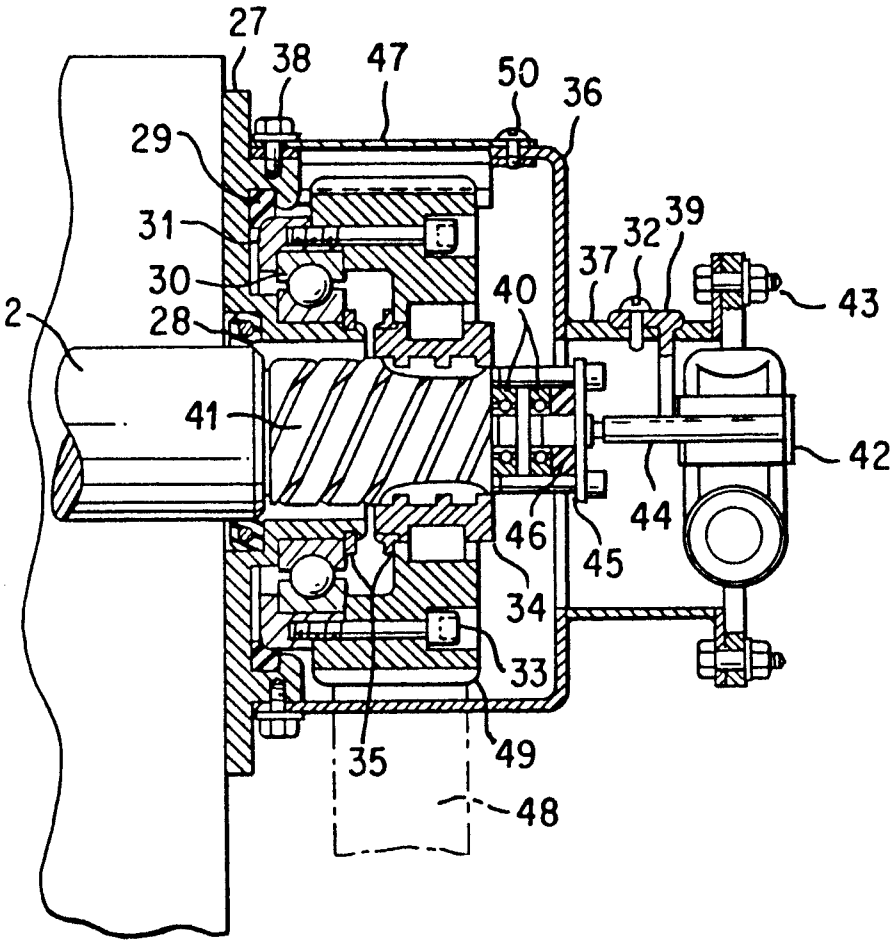
FIG. 2B illustrates a cross-sectional side elevation view of the variator of FIG. 1A taken along the line A—A.
Figure 2A:
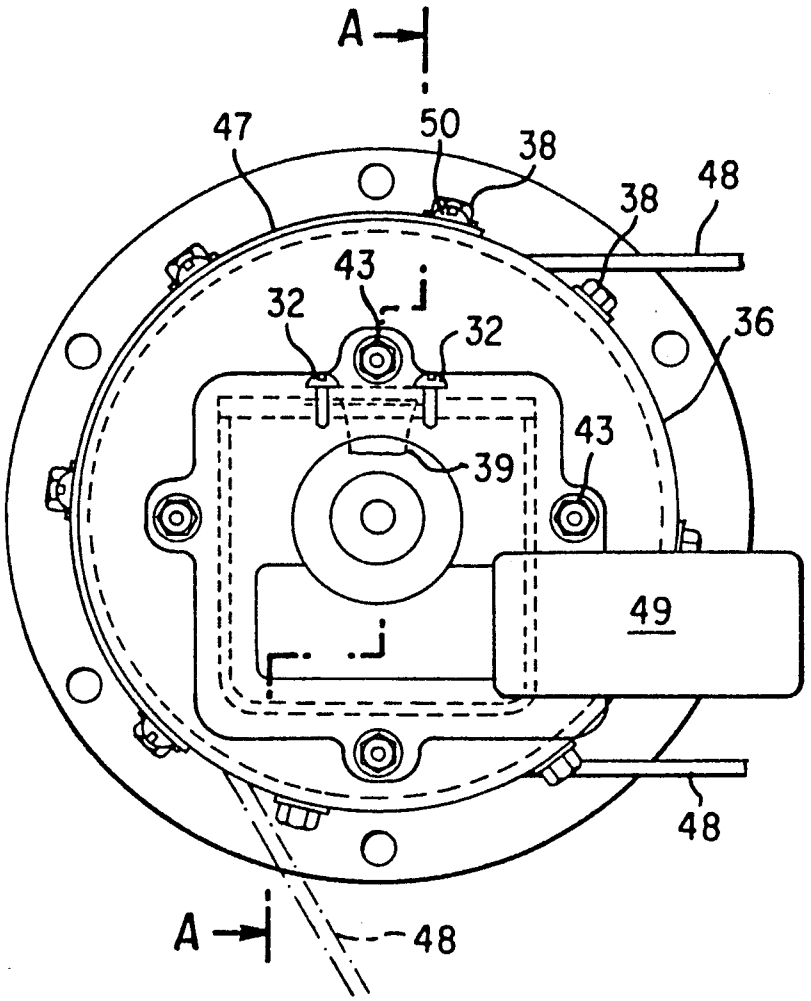
FIG. 2A illustrates a top elevation view of the variator of the present invention

As shown in FIGS. 2A and 2B, a motor reducer 42 forms a single body with a worm gear and an endless worm or screw. A holder plate of the motor reducer 42 is coupled to a motor body 37 by means of screws 43.

The shaft 2 has at its end a grooved trapezoidal screw channel 41 with multiple entrances which is screwed into a hollow and grooved axle box 34 which is engaged with a toothed pulley 49 by means of a pin. The axle box 34 is restrained from moving longitudinally by means of a seeger ring 35. A plate 27 supports the whole unit and is fixed to the block by means of screws 38. The plate 27 supports a ball bearing 30 which is fixed in its position with the seeger ring 15 and rubber locks 28 and 29.

The toothed pulley 49 and the axle box 34 are fixed to the ball bearing 30 by means of a ring 31 and screws 33 such that longitudinal movement of the pulley is restrained and the pulley is only able to turn.

The SVS shaft 2 has etched on its end a housing for axial ball bearings 40. A cap with screws 45 and a rubber lock 46 close the housing.

A pushing spindle 44 is retained between both axial ball bearings 30. The pushing spindle 44 in turn is screwed into the hollow bore of the worm gear of the motor reducer 42. The spindle 44 has a longitudinal square section groove in which a pin 39 enters, in such a way as to prevent the spindle 44 from turning while allowing longitudinal movement. The pin 39 is fixed to the body 37 by means of a screw 32.

When the motor reducer 42 receives a signal, it moves a determined amount of turns or steps. The rotation of the motor reducer 42 is transmitted to the spindle 44 which pushes the shaft 2 along the grooves 41. The shaft 2 thereby turns over itself according to the produced advance. When the motor reducer 42 completes its rotation, the whole unit has produced a differential rotation resulting in advance of the shaft 2 and amplification or reduction of the common area between the shaft perforations or openings 22 and those of its jackets. The rotation of the shaft 2 also changes the valve overlap or timing with respect to the other twin shaft, and with reference to the position of the piston AT the top or bottom of its motion.

Figure 5:
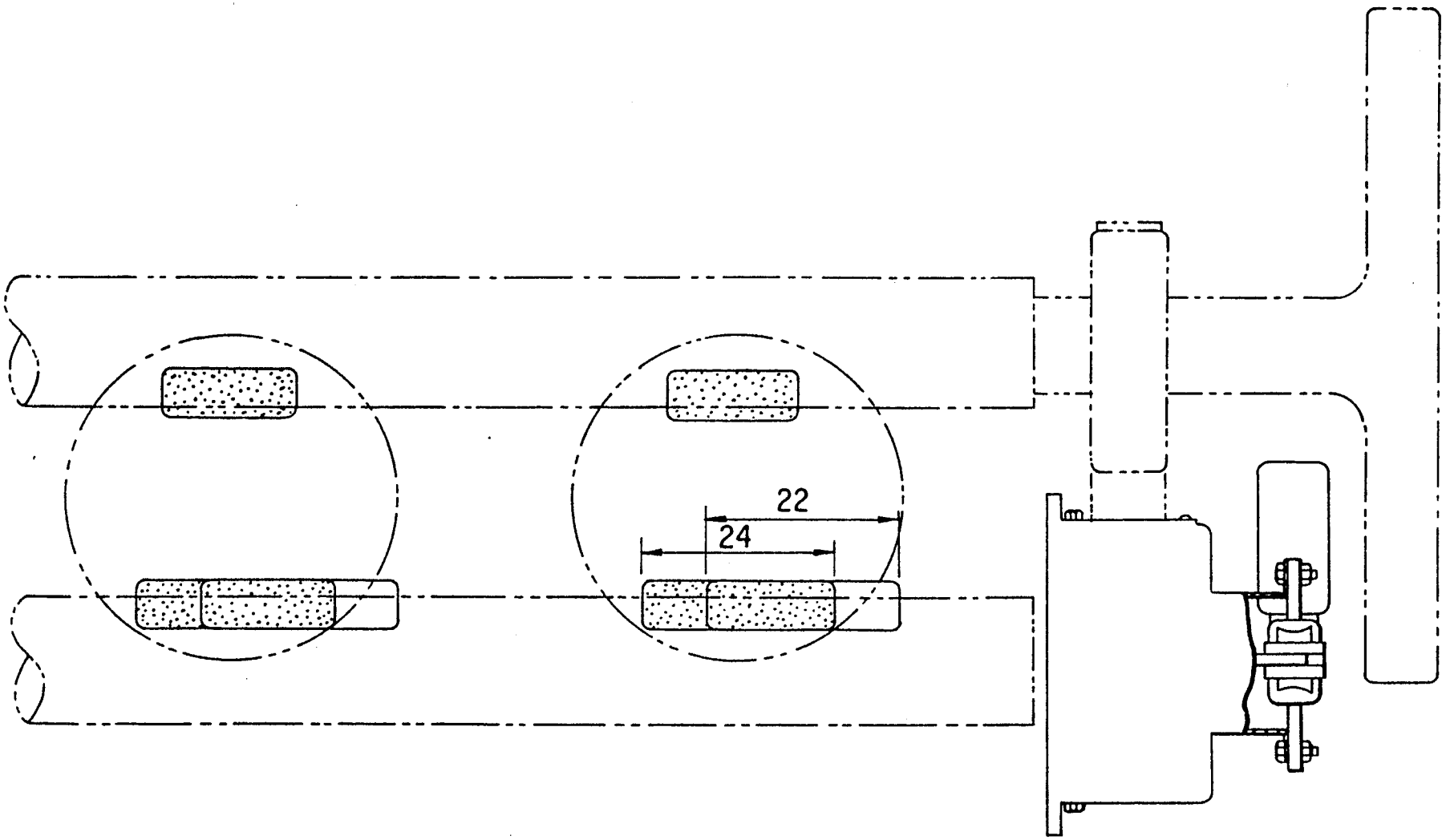
FIG. 5 illustrates the mounting of the system of the present invention in a superior view.

As shown in FIG. 5, the opening for the intake or the exhaust of the mixture or the gases through the cylinder head covers has been indicated at 24 and the opening on the shaft has been indicated at 22. When one shaft is cross turned in respect to the jacket, the opening 22 has been advanced relative to the opening 24. In order to simplify the description, the projections of the openings in FIG. 5 have been indicated without taking into account the turning of the shaft 2. After the shaft 2 is advanced relative to the jacket, the effective opening is determined by the common area between the opening 24 and the opening 22. The maximum possible opening will be area of opening X.

The variation of the valve overlap or timing and the valve section is carried out while the engine is running and at any range of revolutions per minute.

The whole system is protected by a box or housing 36 fixed to the plate 27 by means of the screws 38. A removable cap 47 allows for the change of a distribution belt 48 whose possible positions are indicated at 48.

Figure 3:
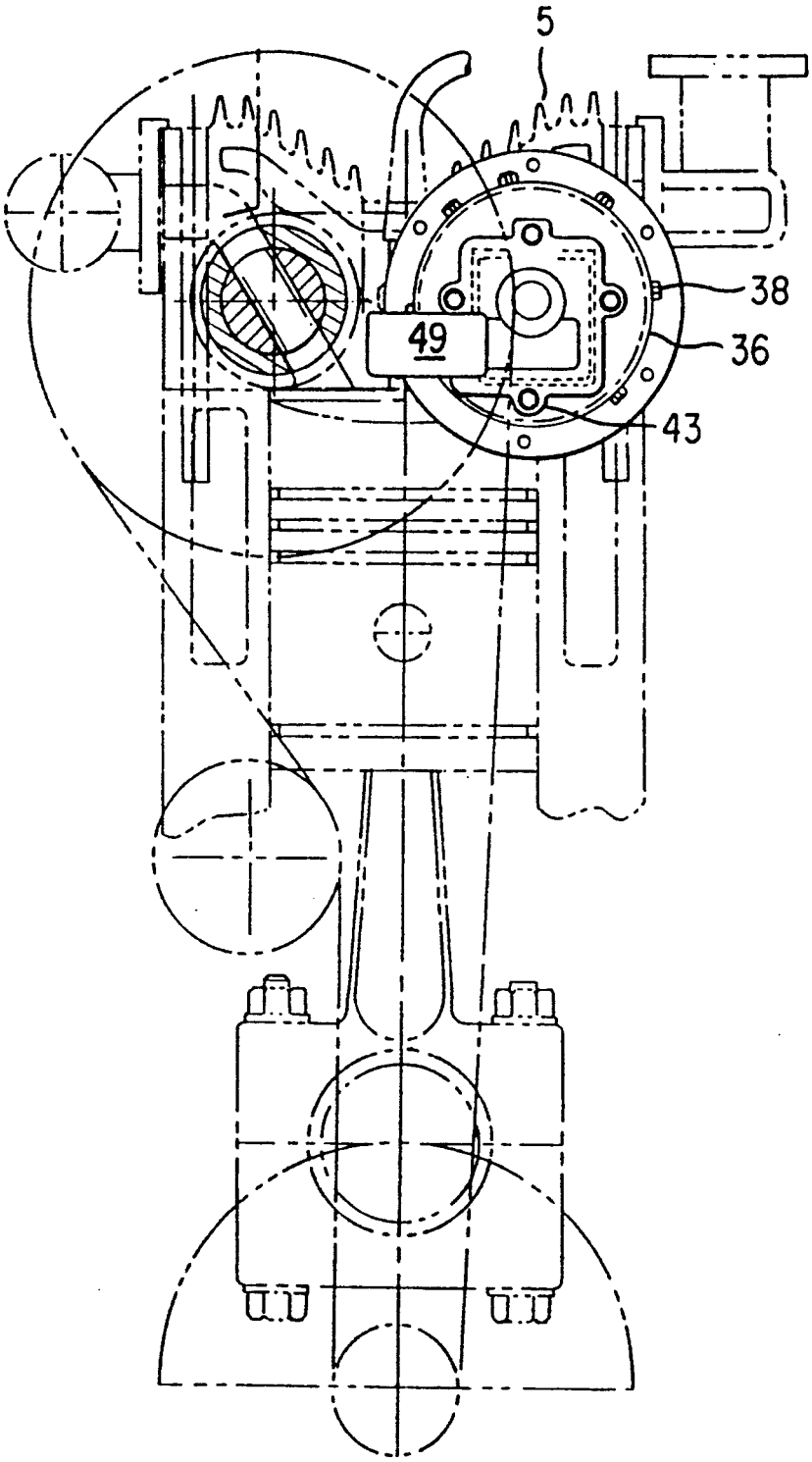
FIG. 3 illustrates the mounting of the system of the present invention on the distribution system illustrated in FIG. 1A in a frontal view.
Figure 4:
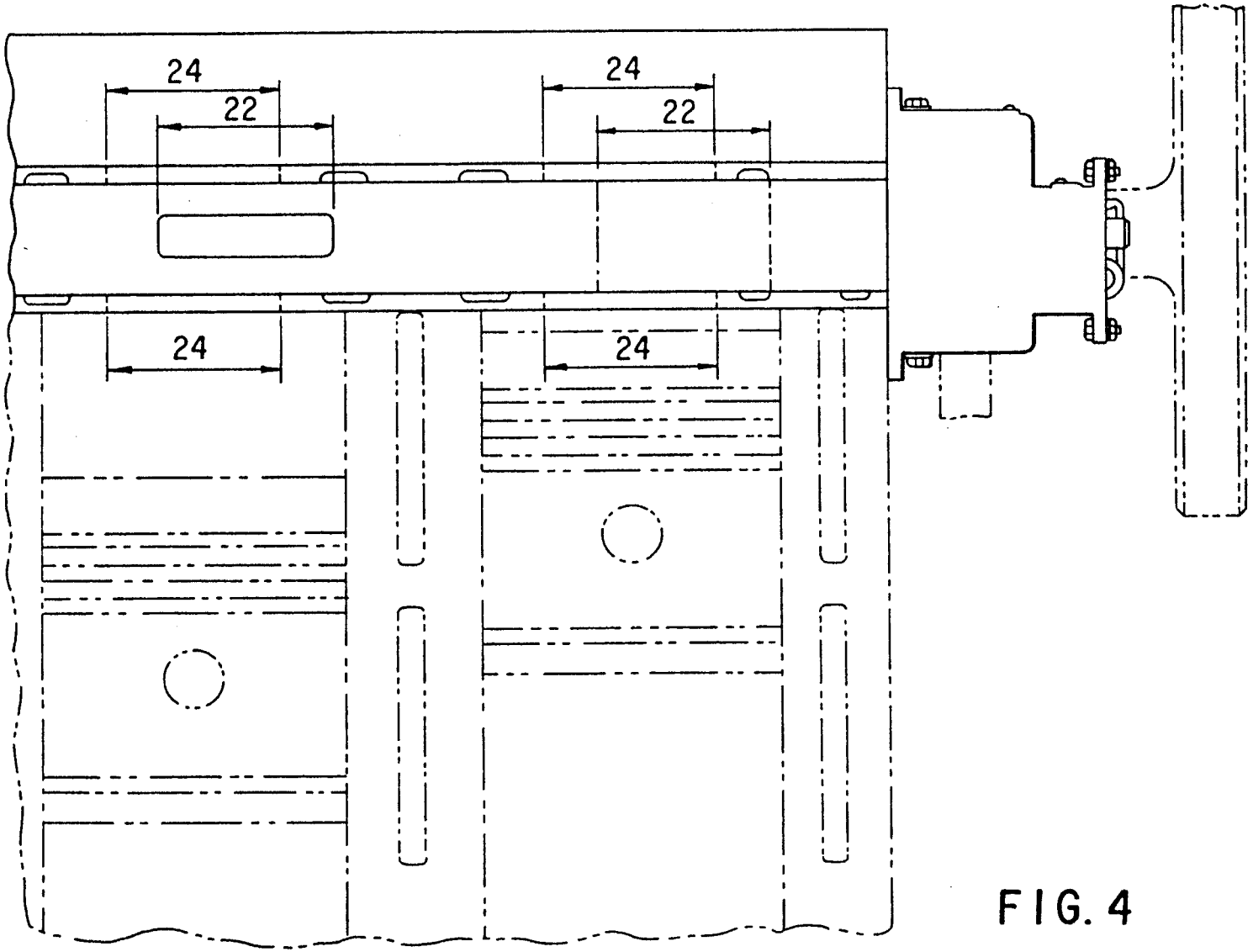
FIG. 4 illustrates the mounting of the system of the present invention in a lateral view.

FIG. 3 shows the mounting of the system in a frontal view, while the mounting of the system laterally is shown in FIG. 4. FIG. 5 shows the top view of the assembly shown in FIG. 4.

The device of the present invention may be moved directly by a separate reducer, by a single body motor reducer of the type having a worm gear or crown and endless worm or screw or by other known type.

The screw threads may be of any known type. The threaded axle box 34 and shaft 2 may have one or multiple entrances of any pitch. In other words, if the pitch were infinite there should be a groove of parallel teeth so that when the spindle 44 pushes the shaft 2 there is only longitudinal movement, without rotation, thereby varying only the valve section in the system. The axle box 34 may be a separate element or form one single body with the pulley. The pulley and the spindle 44 may be mounted on bushings or bearings of any type. Lubrication may be in an independent circuit or, depending on the engine, or may be provided by auto-lubricating mechanisms. The invention may be moved indirectly by the main engine or by an independent, electric, hydraulic or pneumatic or any known type of motor. The spindle 44 may be moved directly or indirectly by hydraulic or pneumatic systems. The invention may be commanded by an electronic or electric circuit, with input of one or more variables or combinations thereof. Further, the invention may be set up with a sensor in such a way that when the main engine stops, the valve overlap position and the valve section return to the position at the point of start up.

The present invention advantageously allows the optimum performance of intake or exhaust of gases at any rate of revolutions per minute, to be obtained automatically. As a result, the present invention allows: (a) greater efficiency in expulsion of exhaust gases; (b) greater efficiency of mixture intake; (c) better combustion in the chambers; (d) greater power generation at a given rate of revolutions per minute; and (e) less combustion residuals due to a better burning of the fuel mixture.

I claim:

1. An automatic variator assembly for varying a valve shaft opening section and valve timing of a double effect distribution sequential valve shaft system in an internal combustion engine which includes an engine block, a cylinder formed in the engine block, the cylinder having a cylinder head, a piston slidable within the cylinder, and a combustion chamber bounded by the cylinder and the piston, and a distribution system consisting of twin rotary valve shafts located within cylindrical jackets within the cylinder head, each shaft having openings from side to side, at different angles in respect of a vertical plane and each jacket having openings in an even way, at a single angle in respect of a vertical plane, establishing a clear conduit whenever the openings match at each half-turn of the shafts, to provide a passage for intake of the fuel mixture or exhaust of combustion gases between the respective cylinder head openings and the intake and exhaust manifolds, the variator assembly comprising:

an automatic mechanism controlled by a microprocessor which is activated by a signal received from a tachometer and gas analyzer;

a spindle for moving one of said valve shafts;

a motor reducer or a step motor or a servo motor activated by said automatic mechanism which turns a number of predetermined turns or steps, causing an end of said spindle to advance and push the valve shaft forward or pull it back;

an axle box; and a multiple-entrance grooved screw etched in at one end of the valve shaft, turning inside said axle box, in such a way that a differential and controlled turn is produced in the shaft when said spindle moves the shaft, causing a rotation of the shaft and longitudinal displacement of the shaft within the jacket surrounding the shaft, thereby varying the valve shaft opening section opening and the valve timing.

2. The variator assembly according to claim 1, wherein said motor reducer has a worm gear and said spindle is screwed into said worm gear.

3. An automatic variator assembly for varying a valve shaft opening section and valve timing of a double effect distribution sequential valve shaft system in an internal combustion engine which includes an engine block, a cylinder formed in the engine block, the cylinder having a cylinder head, a piston slidable within the cylinder, and a combustion chamber bounded by the cylinder and the piston, and a distribution system consisting of twin rotary valve shafts located within cylindrical jackets within the cylinder head, each shaft having an opening extending diametrically therethrough and each jacket having diametrically opposed openings through the walls of the jacket, establishing a clear conduit whenever the openings match at each half-turn of the shafts, to provide an intake passage in communication with the combustion chamber and an exhaust passage in communication with the combustion chamber, the variator assemble comprising:

a spindle for moving one of said valve shafts;

an automatic mechanism controlled by a microprocessor;

a motor activated by said automatic mechanism which turns a number of predetermined turns or steps, causing an end of said spindle to advance and push the valve shaft forward or pull it back;

a threaded sleeve;

a multiple-entrance grooved screw etched in at one end of the valve shaft, turning inside said threaded sleeve, in such a way that a differential and controlled turn is produced in the shaft when said spindle moves the shaft, causing a rotation of the shaft and longitudinal displacement of the shaft within the jacket surrounding the shaft, thereby varying the valve shaft opening section opening and the valve timing.

4. The variator assembly according to claim 3, wherein said threaded sleeve is fixed relative to said spindle and said grooved screw is screwed into said threaded sleeve.

5. The variator assembly according to claim 3, wherein said motor is a motor reducer with a worm gear and said spindle is screwed into said worm gear.

6. The variator assembly according of claim 5, wherein said motor reducer operates in response to said microprocessor which indicates the variations in valve overlap for a predetermined range of revolutions per minute.

7. The variator assembly according of claim 6, wherein said microprocessor operates in response to a tachometer which indicates the variations of valve overlap for a determined range of revolutions per minute.

8. The variator assembly according to claim 3, wherein said motor is a step motor.

9. The variator assembly according to claim 3, wherein said motor is a servo motor.

* * * * *